United States Patent [19]

Dreeszen

[11] Patent Number: 4,792,084

[45] Date of Patent: Dec. 20, 1988

[54] PAPERBOARD CONTAINER WITH ANGLED CORNERS

[75] Inventor: Dale M. Dreeszen, Yakima, Wash.

[73] Assignee: Longview Fibre Company, Longview, Wash.

[21] Appl. No.: 18,870

[22] Filed: Feb. 24, 1987

Related U.S. Application Data

[63] Continuation of Ser. No. 832,413, Feb. 24, 1986, abandoned.

[51] Int. Cl.[4] ..... B65D 5/22

[52] U.S. Cl. ..... 229/109; 229/192; 229/919; 229/DIG. 11

[58] Field of Search ..... 229/23 R, 41 C, 41 D, 229/109, 190, 192, 915, 918, 919, DIG. 11

[56] References Cited

U.S. PATENT DOCUMENTS

| | | | |
|---|---|---|---|
| 204,022 | 5/1878 | Gibson | 229/109 |
| 1,160,990 | 11/1915 | Obenchain et al. | 229/109 |
| 1,554,099 | 9/1925 | Kolbe | 229/192 |
| 2,147,563 | 2/1939 | Turner | 229/109 |
| 2,201,462 | 5/1940 | Wells et al. | 229/918 |
| 2,522,597 | 9/1950 | Blandford | 229/192 |
| 2,718,998 | 9/1955 | Bemiss | 229/195 |
| 3,276,660 | 10/1966 | Vesak | 229/190 |
| 3,474,901 | 10/1969 | Viater | 229/109 |
| 3,850,362 | 11/1974 | Stollberg et al. | 229/23 R |

FOREIGN PATENT DOCUMENTS

| | | | |
|---|---|---|---|
| 1320926 | 2/1963 | France | 229/41 C |
| 112204 | 10/1944 | Sweden | 229/190 |
| 1409122 | 10/1975 | United Kingdom | 229/190 |
| 1529976 | 10/1978 | United Kingdom | 229/190 |

*Primary Examiner*—Stephen Marcus
*Assistant Examiner*—Gary E. Elkins
*Attorney, Agent, or Firm*—Olson and Olson

[57] ABSTRACT

A paperboard carton is formed from a single blank of generally rectangular shape which is cut and scored along lines which provide corner panels at the four corners and middle panels separated from the corner panels along one pair of opposite sides of the blank by two laterally spaced pairs of two laterally spaced cut lines connected at their inner ends by an angularly directed cut line, and along the other pair of opposite sides of the blank by two laterally spaced pairs of two laterally spaced score lines which define between them an angle corner panel. The inner ends of the middle panels are defined by score lines which, together with the angle cut lines, define the peripheral margin of a central bottom panel. The middle panels form the ends and sides of the carton. In one specific embodiment, each of the pair of opposite middle panels defined by the spaced pairs of cut lines is provided with a score line which extends parallel to the adjacent cut line and terminates at its inner end at the corresponding end of the angular cut line, whereby the portion of the blank between the last mentioned score and cut lines forms a reinforcing angle corner panel.

2 Claims, 3 Drawing Sheets

PAPERBOARD CONTAINER WITH ANGLED CORNERS

This application is a continuation of application Ser. No. 832,413, filed Feb. 24, 1986 and now abandoned.

BACKGROUND OF THE INVENTION

This invention relates to paperboard cartons, and more particularly to a paperboard carton having angled corners for increased stacking strength.

Paperboard cartons have been provided heretofore in a wide variety of shapes, sizes and constructions. Some of these have been provided with special corner constructions designed for specific purposes. For example, U.S. Pat. Nos. 3,917,155; 3,863,830; and 3,536,248 disclose corner constructions designed to provide increased sealing against leakage of liquids. U.S. Pat. No. 3,193,174 discloses a corner construction designed to provide a snap-lock cover for nestable boxes. U.S. Pat. Nos. 3,361,325 and 4,417,686 disclose special corner constructions designed to provide increased strength. The angled corner tray construction provided by U.S. Pat. No. 4,417,686 is integrated with structure which provides reinforced hand holes at the opposite ends of the tray.

SUMMARY OF THE INVENTION

This invention provides a carton with external angled corners by cutting and folding a paperboard blank along lines by which angled carton corner panels and attached blank corner panels are separated from adjacent carton side or end panels by a space defined by two laterally spaced pairs of two spaced cuts extending inwardly from one pair of opposite sides of the blank and by two laterally spaced pairs of two spaced score lines extending inwardly from the other pair of opposite sides of the blank.

It is the principal objective of this invention to provide a paperboard carton of the class described having angled corners and formed by means of an inexpensive blank of simplified configuration.

Another object of this invention is to provide a paperboard carton of the class described in which the angled corners may be joined to either end or side panels of the carton.

Still another objective of this invention is the provision of a paperboard carton of the class described in which the angled corners are reinforced with second-ply angled corners.

A further object of this invention is to provide a paperboard carton of the class described which is of simplified construction for economical manufacture and use.

The foregoing and other objects and advantages of this invention will appear from the following detailed description, taken in connection with the accompanying drawings of preferred embodiments.

DESCRIPTION OF THE PREFERRED EMBODIMENTS

Figure 1:
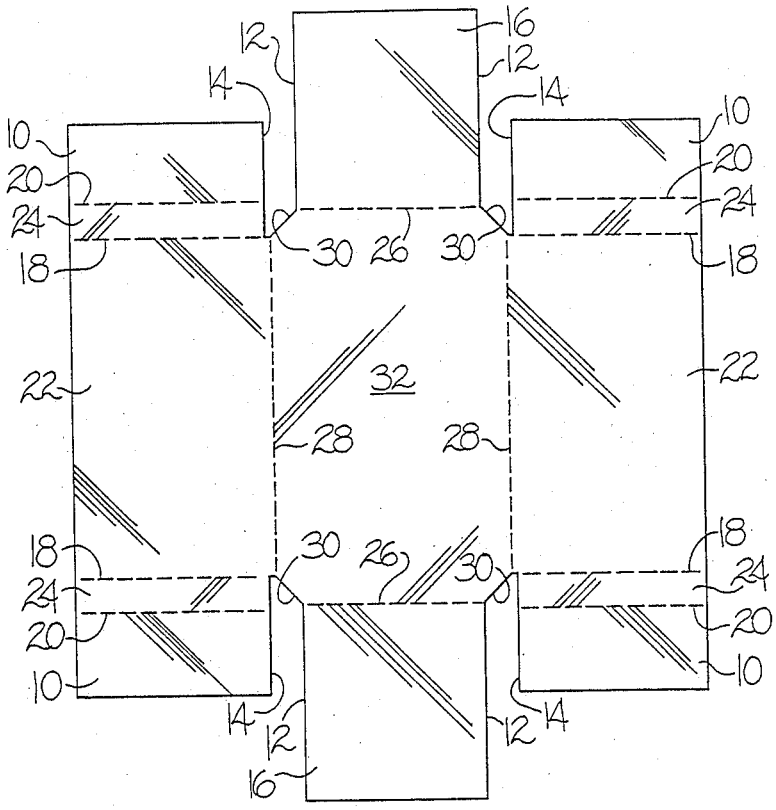
FIG. 1 is a plan view of a blank provided with one arrangement of solid cut lines and broken score lines to provide one form of carton with angled corners in accordance with this invention.

In all illustrated forms of the invention, a substantially rectangular blank of paperboard, preferably cardboard, is provided with a pattern of cut and score lines arranged to provide on each of the four sides of the blank a middle panel separating corner panels each of which includes an outer corner panel and an inner angular corner panel. A central, bottom panel is bounded by the four middle panels.

Thus, in each of the illustrated forms of the invention the blank is shown to be generally rectangular in shape. Each of one pair of opposed sides of the blank has corner panels 10 separated by two laterally spaced pairs of cut lines. Each pair consists of an inner cut line 12 and an outer cut line 14. The inner cut lines define the lateral ends of a first middle panel 16.

Each of the other pair of opposite sides of the blank also has end corner panels 10 separated by two laterally spaced pairs of score lines. Each pair consists of an inner score line 18 and an outer score line 20. The inner score lines define the lateral ends of a second middle panel 22.

The space between the inner and outer score lines of each pair defines an angle corner panel 24.

The inner end of each of the first middle panels 16 is defined by score line 26, and the inner end of each of the second middle panels 22 is defined by score line 28. The opposite ends of the score lines 26 and 28 terminate at the inner ends of the cut lines 12 and 14 and are joined by the angular cut lines 30. The length of cut line 30 is substantially the same as the width of the angle corner panel 24.

The score lines 26 and 28 and angular cut lines 30 define the peripheral margin of the central, bottom panel 32.

Figure 2:
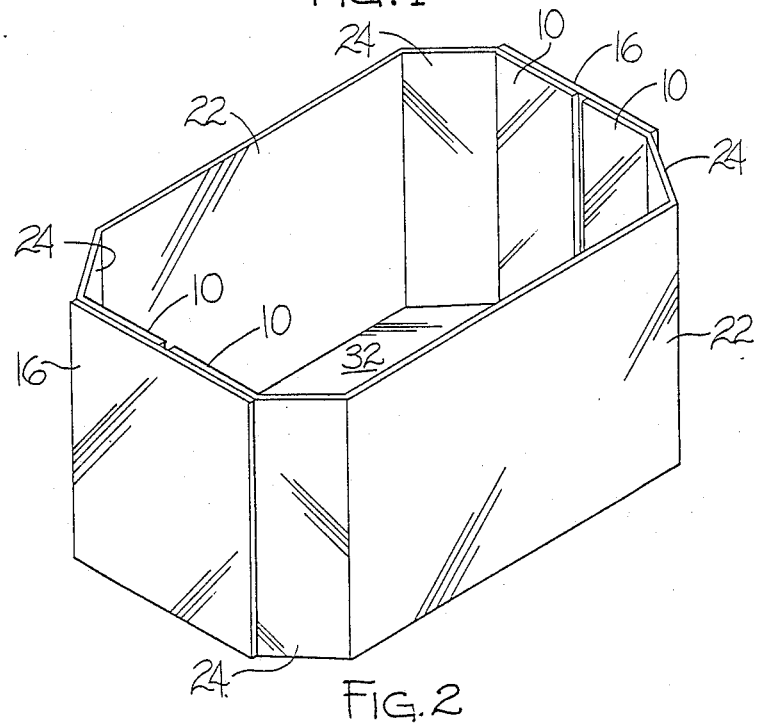
FIG. 2 is a perspective view of a carton formed from the blank of FIG. 1.

In FIGS. 1 and 2 of the drawings, the first middle panels 16 form the opposite ends of the carton, while the second middle panels 22 form the sides of the carton. Conversely, in FIGS. 3, 4, and 5, 6 the first middle panels 16 form the sides of the carton and the second middle panels 22 form the ends of the carton.

Figure 3:
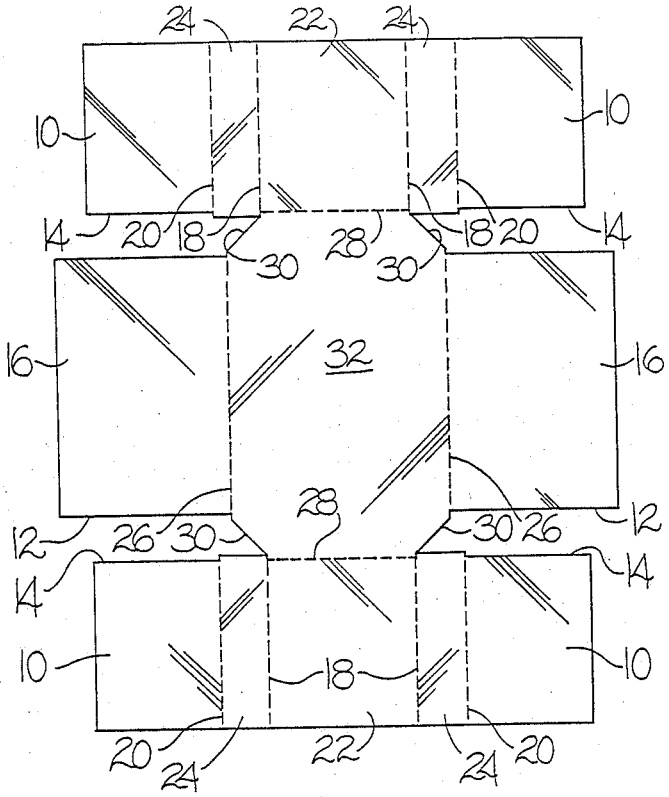
FIG. 3 is a plan view of a blank provided with a second arrangement of solid cut lines and broken score lines to provide a second form of carton with angled corners in accordance with this invention.
Figure 4:
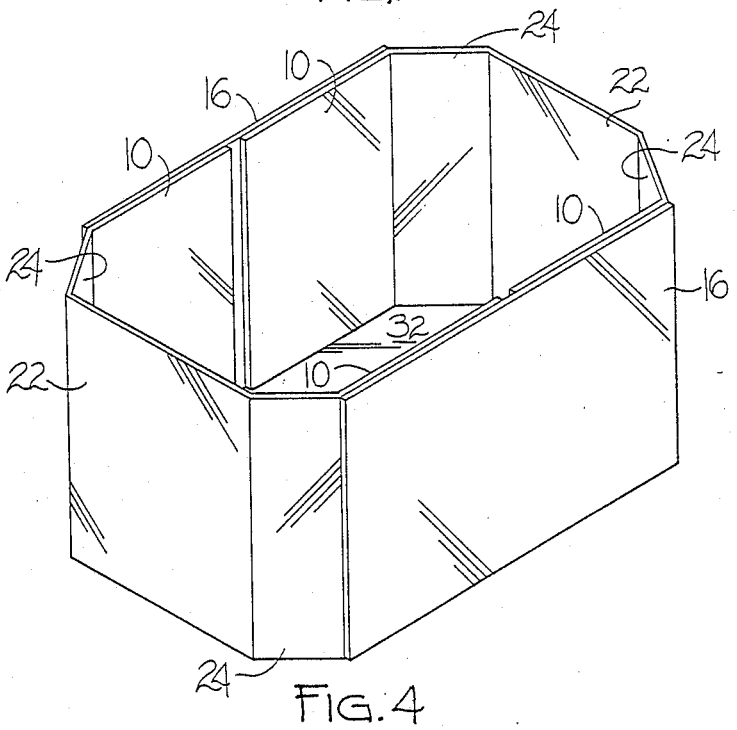
FIG. 4 is a perspective view of a carton formed from the blank of FIG. 3.

In forming the cartons of FIGS. 2 and 4 from the blanks of FIGS. 1 and 3, respectively, the second middle panels 22 are bent upwardly along the score lines 28 to a position perpendicular to bottom panel 32. The angled corner panels 24 then are bent along the inner score lines 18 so that they extend along the angles cut lines 30. The outer corner panels 10 then are bent along the score lines 20 to extend along the score lines 26.

The first middle panels 16 then are bent upwardly along the score lines 26 to abut the outer sides of the corner panels 10. The corner panels 10 and abutting middle panels 16 may be secured together in any desired manner, as by glue, staples, etc.

It is to be observed that the dimension of the corner panels 10 between the score line 20 and the confronting opposite side thereof preferably is not greater than onehalf the dimension of middle panel 16 between the opposed cut lines 12. The two corner panels 10 abutting the middle panel 16 thus need not overlap. It is also to be noted. that the dimension of the corner panels 10 parallel to the score lines 18, 20 preferably is the same as the dimension of middle panel 16 between the score line 26 and the outer margin. These dimensions represent the depth of the carton, as will be evident from FIGS. 2, 4 and 6.

Figure 5:
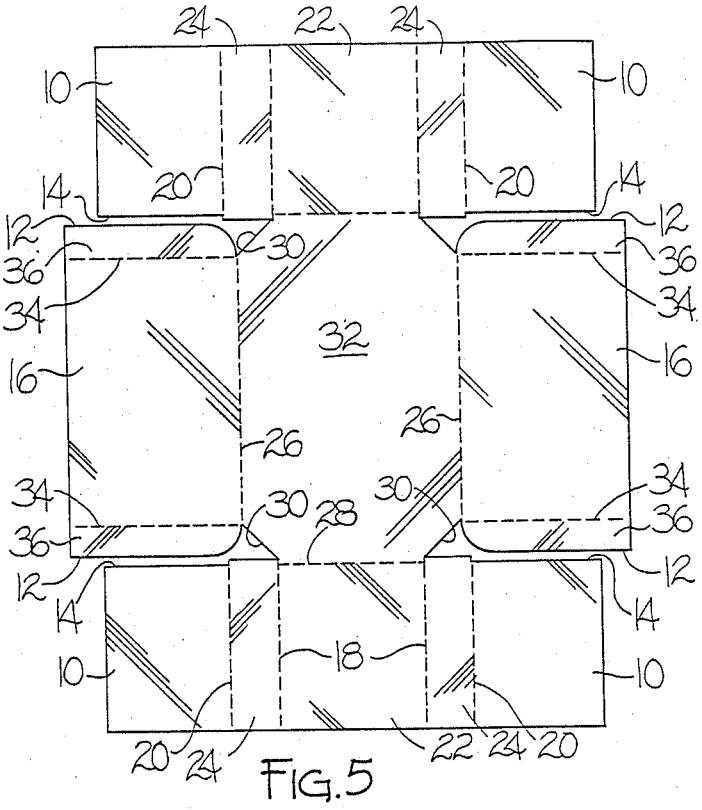
FIG. 5 is a plan view of a blank provided with a third arrangement of solid cut lines and broken score lines to provide a third form of carton with angled corners in accordance with this invention.
Figure 6:
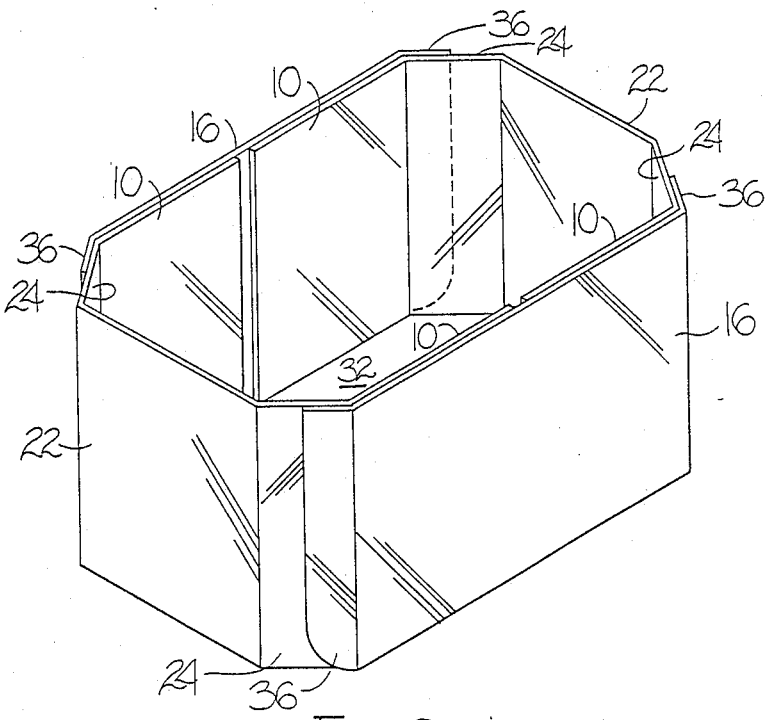
FIG. 6 is a perspective view of a carton formed from the blank of FIG. 5.

In the embodiment illustrated in FIGS. 5 and 6, the first middle panels 16 are provided with score lines 34 inwardly of their opposite ends and parallel to the cut lines 12. These cut lines 12 terminate at their inner ends at the inner ends of the score lines 34 and at the juncture of the associated angle cut line 30.

Accordingly, after the various panels have been folded in the manner described hereinbefore with reference to FIGS. 1–4, with the first middle panels 16 abutting the outer sides of the corner panels 10, the reinforcing angle corner panels 36 formed between the score lines 34 and cut lines 12 are bent along the score lines 34 to abut the outer sides of the angled corner panels 24. The reinforcing angled corner panels 36 and the main angle corner panels 24 are secured together by glue, staples, or other means desired.

It is to be noted in FIG. 1 that the score lines 28 are offset slightly inward from the associated cut lines 14. Thus, when the middle panels 22 are bent upward to a position perpendicular to the bottom panel 32 and the angled corner panels 24 and end corner panels 10 are bent inwardly to align with the angular cuts 30 and score lines 28, respectively, the cut lines 14 bear against the upper surface of the bottom panel 32.

In the embodiments illustrated in FIGS. 3 and 5, the cut lines 14 for the inner ends of the angle corner panels 24 are offset inwardly relative to the cut lines 14 for the adjacent corner panels 10, and the score lines 28 are offset outwardly therefrom. Accordingly, when the middle panels 22 are bent upward to a position perpendicular to the bottom panel 32, the inner ends of the angle corner panels 24 abut the outer edges of the angle cut lines 30. However, the bottom edges of the outer corner panels 10 defined by the cut lines 14 bear against the top surface of the bottom panel 32.

The carton construction of this invention, which provides angled corners 24, has been determined to increase the stacking strength over square cornered cartons formed by the same type of paperboard material, by at least 15%. The addition of the second ply of reinforcing angled corner panels 36 illustrated in FIGS. 5 and 6, increases the stacking strength still further.

Although the cartons described hereinbefore are open at their top ends, it will be understood that suitable covers may be provided.

It will also be apparent to those skilled in the art that various changes may be made in the size, shape and type of foldable carton-forming blank material described hereinbefore, without departing from the spirit of this invention and the scope of the appended claims.

Having now described my invention in various embodiments, I claim:

1. A blank for a paperboard carton, comprising:

(a) a substantially rectangular, one-piece, carton-forming blank of foldable material having four corners, (b) corner panels (10) at the four corners of the blank separated from adjacent first middle panels (16) along each of one pair of opposite sides of the blank by two spaced pairs of two substantially parallel spaced inner cut lines (12) and outer cut lines (14) extending inwardly from said one pair of opposite sides of the blank and defining a first middle panel (16) between the inner cut lines (12) of the pairs of cut lines and separated from adjacent second middle panels (22) along each of the other pair of opposite sides of the blank by two spaced pairs of substantially parallel spaced inner score lines (18) and outer score lines (20) extending inwardly from said other pair of opposite sides of the blank and defining between the inner score lines (18) of the pairs of score lines a second middle panel (22) and defining between the score lines (18, 20) of each pair an angle corner panel (24), each of the inner (12) and outer (14) cut lines and inner (18) and outer (20) score lines having inner and outer ends, (c) a score line (26) extending between the inner ends of the inner cut lines (12) of the two pairs of spaced cut lines (12, 14) and defining the inner end of the associated first middle panel (16), (d) a score line (28) interconnecting the inner ends of the inner score lines (18) of the two spaced pairs of score lines at each of the other pair of opposite sides of the blank and defining the inner end of the associated second middle panel (22), (e) a cut line (30) extending obliquely between the inner ends of the two spaced cut lines (12, 14) of each pair of cut lines, the width of each angle corner panel (24) between the associated inner and outer score lines (18, 20) being substantially the same as the length of the associated cut line (30), and (f) the score lines (26, 28) forming the inner ends of the first and second middle panels (16, 22) and the obliquely extending cut lines (30) defining the periphery of a central, bottom panel (32), (g) the inner end of each of the angle corner panels (24) terminating inwardly of the inner end of the associated corner panel (10) and inwardly of the score line (28) defining the inner end of the associated second middle panel (22), whereby the inner end of each angle corner panel (24) abuts the outer edge of the associated oblique cut line (30) when the blank is folded to form a carton.

2. A blank for a paperboard carton, comprising:

(a) a substantially rectangular, one-piece, carton-forming blank of foldable material having four corners, (b) corner panels (10) at the four corners of the blank separated from adjacent first middle panels (16) along each of one pair of opposite sides of the blank by two spaced pairs of substantially parallel spaced inner cut lines (12) and outer cut lines (14) extending inwardly from said one pair of opposite sides of the blank and defining a first middle panel (16) between the inner cut lines (12) of the pairs of cut lines and separated from adjacent second middle panels (22) along each of the other pair of opposite sides of the blank by two spaced pairs of substantially parallel spaced inner score lines (18) and outer score lines (20) extending inwardly from said other pair of opposite sides of the blank and defining between the inner score lines (18) of the pairs of score lines a second middle panel (22) and defining between the score lines (18, 20) of each pair an angle corner panel (24), each of the inner (12) and outer (14) cut lines and inner (18) and outer (20) score lines having inner and outer ends, (c) a score lines (26) extending between the inner ends of the inner cut lines (12) of the two pairs of spaced cut lines (12, 14) and defining the inner end of the associated first middle panel (16), (d) a score line (28) interconnecting the inner ends of the inner score lines (18) of the two spaced pairs of score lines at each of the other pair of opposite sides of the blank and defining the inner end of the associated second middle panel (22), (e) a cut line (30) extending obliquely between the inner ends of the two spaced cut lines (12, 14) of each pair of cut lines, the width of each angle corner panel (24) between the associated inner and outer score lines (18, 20) being substantially the same as the length of the associated cut lines (30), (f) the score lines (26, 28) forming the inner ends of the first and second middle panels (16, 22) and the obliquely extending cut lines (30) defining the periphery of a central, bottom panel (32), (g) the inner end of eachn of the angle corner panels (24) terminating inwardly of the inner end of the associated corner panel (10) and inwardly of the score line (28) defining the inner end of the associated second middle panel (22), whereby the inner end of each angle corner panel (24) abuts the outer edge of the associated oblique cut line (30) when the blank is folded to form a carton, and (h) a score line (34) in each first middle panel (16) spaced inwardly of and extending substantially parallel to each of the first named inner cut lines (12) and said score line (34) terminating at its inner end at the associated oblique cut line (30), the blank material between each said score line (34) in each first middle panel (16) and the associated inner cut line (12) defining a reinforcing angle corner panel (36) for lapping an associated angle corner panel (24).

* * * * *